US011789399B2

(12) United States Patent
Hase

(10) Patent No.: US 11,789,399 B2
(45) Date of Patent: Oct. 17, 2023

(54) IMAGE FORMING APPARATUS WHICH CHANGES SPEED IN LAMINATION MODE

(71) Applicant: Takamasa Hase, Kanagawa (JP)

(72) Inventor: Takamasa Hase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/750,356

(22) Filed: May 22, 2022

(65) Prior Publication Data

US 2023/0004106 A1 Jan. 5, 2023

(30) Foreign Application Priority Data

Jul. 5, 2021 (JP) ..... 2021-111722

(51) Int. Cl.
*G03G 15/00* (2006.01)
*G03G 15/20* (2006.01)

(52) U.S. Cl.
CPC ..... *G03G 15/6591* (2013.01); *G03G 15/6582* (2013.01); *G03G 15/2017* (2013.01); *G03G 2215/00502* (2013.01); *G03G 2215/00789* (2013.01); *G03G 2215/2045* (2013.01)

(58) Field of Classification Search
CPC ..... G03G 15/2017; G03G 15/2021; G03G 15/6573; G03G 15/6582; G03G 15/6585; G03G 15/6591; G03G 2215/00502; G03G 2215/00789; G03G 2215/00805; G03G 2215/00949; G03G 2215/2045; B41J 11/0015
USPC ..... 399/342
See application file for complete search history.

(56) References Cited

U.S. PATENT DOCUMENTS 5,729,818 A * 3/1998 Ishizuka ..... G03G 15/657 399/68
5,894,318 A 4/1999 Endo
2004/0095451 A1* 5/2004 Tatsumi ..... B41J 11/0024 347/101
2005/0163522 A1* 7/2005 Carlson ..... G03G 15/2064 399/342
2006/0144510 A1 7/2006 Cahill
2011/0026988 A1 2/2011 Yoshikawa et al.
2011/0044734 A1 2/2011 Shimokawa et al.
2011/0058862 A1 3/2011 Yamaguchi et al.
2011/0064443 A1 3/2011 Iwaya et al.
(Continued)

FOREIGN PATENT DOCUMENTS

JP 62-113182 5/1987
JP S62297860 A 12/1987
(Continued)

OTHER PUBLICATIONS

European Search Report; Application EP22174276; dated Nov. 11, 2022.

*Primary Examiner* — Robert B Beatty
(74) *Attorney, Agent, or Firm* — Duft & Bornsen, PC

(57) ABSTRACT

An image forming apparatus includes a fixing device and a drive transmission mechanism. The fixing device fixes an image on a sheet by application of heat and pressure. The drive transmission mechanism changes a conveying speed of the sheet in the fixing device between an image forming mode and a lamination mode. The conveying speed of the sheet in the fixing device in the lamination mode is lower than the conveying speed of the sheet in the fixing device in the image forming mode.

12 Claims, 4 Drawing Sheets

(56) References Cited

U.S. PATENT DOCUMENTS

2011/0064490 A1 3/2011 Imada et al.
2011/0064502 A1 3/2011 Hase et al.
2011/0129268 A1 6/2011 Ishii et al.
2011/0150518 A1 6/2011 Hase et al.
2011/0182638 A1 7/2011 Ishii et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0217056 A1 9/2011 Yoshinaga et al.
2011/0222876 A1 9/2011 Yuasa et al.
2011/0222926 A1 9/2011 Ueno et al.
2011/0222929 A1 9/2011 Fujimoto et al.
2011/0222930 A1 9/2011 Fujimoto et al.
2011/0229162 A1 9/2011 Ogawa et al.
2011/0229181 A1 9/2011 Iwaya et al.
2011/0229226 A1 9/2011 Tokuda et al.
2011/0293309 A1 12/2011 Hase
2011/0318078 A1* 12/2011 Aoi ..... G03G 15/6573 399/381
2012/0045226 A1 2/2012 Hase et al.
2012/0093551 A1 4/2012 Ogawa et al.
2012/0114354 A1 5/2012 Saito et al.
2012/0177388 A1 7/2012 Imada et al.
2012/0207523 A1 8/2012 Ueno et al.
2013/0045032 A1 2/2013 Shimokawa et al.
2013/0136479 A1 5/2013 Yuasa et al.
2013/0164056 A1 6/2013 Imada et al.
2013/0164059 A1 6/2013 Takagi et al.
2013/0170877 A1 7/2013 Yoshiura et al.
2013/0170879 A1 7/2013 Yoshinaga et al.
2013/0170880 A1 7/2013 Gotoh et al.
2013/0188977 A1 7/2013 Hase et al.
2013/0189005 A1 7/2013 Saito et al.
2013/0189008 A1 7/2013 Ishii et al.
2013/0195477 A1 8/2013 Seshita et al.
2013/0195523 A1 8/2013 Yamaji et al.
2013/0195524 A1 8/2013 Ishii et al.
2013/0202320 A1 8/2013 Hase et al.
2013/0209115 A1 8/2013 Hase et al.
2013/0209119 A1 8/2013 Yuasa et al.
2013/0209121 A1 8/2013 Uchitani et al.
2013/0209124 A1 8/2013 Saito et al.
2013/0209128 A1 8/2013 Saito et al.
2013/0209131 A1 8/2013 Uchitani et al.
2013/0209147 A1 8/2013 Ogawa et al.
2013/0251422 A1 9/2013 Iwaya et al.
2014/0342283 A1 11/2014 Yamamoto et al.
2014/0363184 A1 12/2014 Santo et al.
2015/0160591 A1 6/2015 Hase et al.
2016/0274514 A1 9/2016 Ishii et al.
2016/0334742 A1 11/2016 Kobashigawa et al.
2017/0185019 A1 6/2017 Seo et al.
2017/0255150 A1 9/2017 Hase et al.
2020/0033766 A1 1/2020 Hase et al.
2021/0223730 A1 7/2021 Hase et al.
2021/0294229 A1 9/2021 Sugiura et al.
2021/0311420 A1 10/2021 Yoshinaga et al.
2021/0389702 A1* 12/2021 Kimura ..... G03G 15/2039
2022/0011697 A1* 1/2022 Kimura ..... G03G 15/20

FOREIGN PATENT DOCUMENTS

JP 2772529 B2 * 7/1998
JP 2820733 B2 * 11/1998
JP 2015025908 A 2/2015
JP 2016-161744 9/2016
JP 2017-102317 6/2017
JP 2018-180400 11/2018
JP 2018-185379 11/2018

* cited by examiner

IMAGE FORMING APPARATUS WHICH CHANGES SPEED IN LAMINATION MODE

CROSS-REFERENCE TO RELATED APPLICATION

This patent application is based on and claims priority pursuant to 35 U.S.C. § 119(a) to Japanese Patent Application No. 2021-111722, filed on Jul. 5, 2021, in the Japan Patent Office, the entire disclosure of which is hereby incorporated by reference herein.

BACKGROUND

Technical Field

Embodiments of the present disclosure relate to an image forming apparatus.

Related Art

Image forming apparatuses are known to include a fixing device to heat and press a sheet so that an image is fixed on the sheet. For example, a known image forming apparatus has a printing mode (image forming mode) and a lamination mode. The known image forming apparatus performs a laminating process by heating and pressing of a fixing device in the lamination mode.

SUMMARY

According to an embodiment of the present disclosure, a novel image forming apparatus includes a fixing device and a drive transmission mechanism. The fixing device fixes an image on a sheet by application of heat and pressure. The drive transmission mechanism changes a conveying speed of the sheet in the fixing device between an image forming mode and a lamination mode. The conveying speed of the sheet in the fixing device in the lamination mode is lower than the conveying speed of the sheet in the fixing device in the image forming mode.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
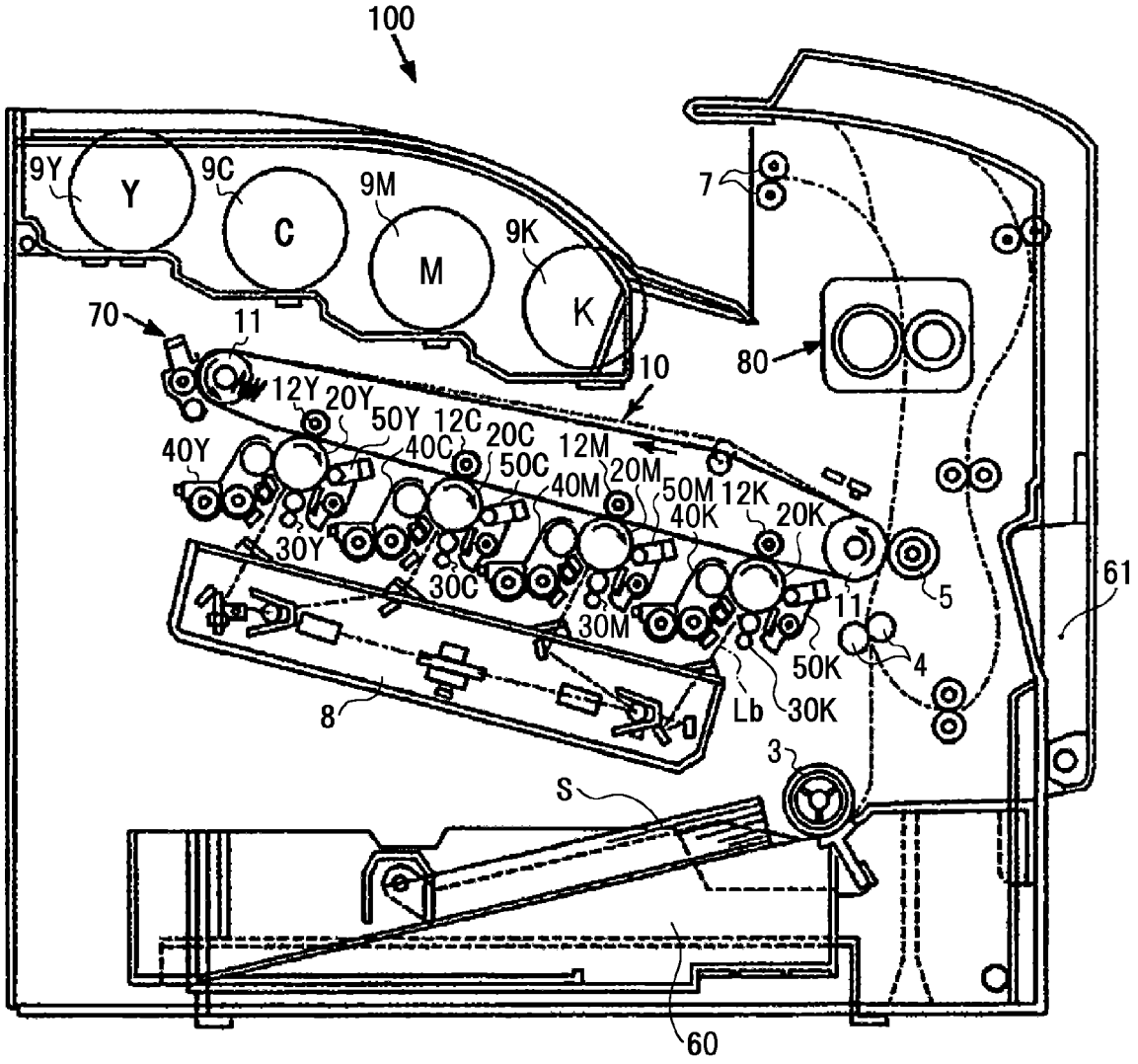
FIG. 1 is a schematic view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Descriptions are given of an electrophotographic image forming apparatus according to an embodiment of the present disclosure. FIG. 1 is a schematic view of an image forming apparatus according to an embodiment of the present disclosure. A printer 100 serving as the image forming apparatus according to the present embodiment includes a sheet feeding device 60, a registration roller pair 4, photoconductor drums 20Y, 20C, 20M, and 20K serving as image bearers, a primary transfer device 12, a secondary transfer device including a secondary transfer roller 5, and a fixing device 80. The printer 100 is a four-color tandem type of image forming apparatus that forms toner images of respective colors of yellow (Y), cyan (C), magenta (M), and black (K) on the photoconductor drums 20Y, 20C, 20M, and 20K.

The sheet feeding device 60 includes a sheet feeding tray and a sheet feed roller 3. The sheet feeding tray loads a stack of a plurality of sheets S serving as recording media. The sheet feed roller 3 separates and feeds the sheets S loaded in the sheet feeding tray one by one starting from the uppermost sheet. The sheet S fed by the sheet feed roller 3 is temporarily stopped by the registration roller pair 4 and corrected for positional deviation. Then, the registration roller pair 4 sends the sheet S to a secondary transfer nip formed by an intermediate transfer belt 10 and the secondary transfer roller 5, at a timing in synchrony with rotation of the photoconductor drums 20 and the intermediate transfer belt 10, that is, at a timing at which a leading edge of a toner image formed on the intermediate transfer belt 10 from the photoconductor drums 20 meets a certain position of a leading edge of the sheet S in a sheet conveyance direction. One of supporting rollers 11 is disposed facing the secondary transfer roller 5 via the inner surface of the intermediate transfer belt 10 while the secondary transfer roller 5 contacts the outer surface of the intermediate transfer belt 10.

The printer 100 serving as the image forming apparatus according to the present embodiment includes a charging roller 30 as a charging device, an exposure device 8, a developing device 40 including a developing roller, the primary transfer device 12, and a cleaning device 50 including a cleaning blade in this order around the photoconductor drum 20 of each color in the direction of rotation of the photoconductor drum 20 indicated by each arrow. The exposure device 8 irradiates and scans an exposure area between the charging roller 30 and the developing device 40 on the photoconductor drum 20 with a laser beam Lb via mirrors.

Toner bottles 9Y, 9C, 9M, and 9K containing respective color toners are detachably attached to the printer 100 above the intermediate transfer belt 10. Each of the color toners respectively contained in the toner bottles 9Y, 9C, 9M, and 9K is supplied to the developing device 40 (i.e., the developing device 40Y, 40C, 40M, or 40K) of the corresponding color.

After the photoconductor drum 20 (i.e., the photoconductor drum 20Y, 20C, 20M, or 20K) starts to rotate, the charging roller 30 (i.e., the charging roller 30Y, 30C, 30M, or 30K) uniformly charges the surface of the photoconductor drum 20. Then, the exposure device 8 irradiates and scans the exposure area with the laser beam Lb based on image data to form an electrostatic latent image corresponding to an image to be created. The rotation of the photoconductor drum 20 moves the electrostatic latent image to a position facing the developing device 40. At the position, the developing device 40 supplies toner to the electrostatic latent image to visualize the electrostatic latent image as a toner image. The primary transfer device 12 (i.e., the primary transfer device 12Y, 12C, 12M, or 12K) applies a transfer bias to the intermediate transfer belt 10 to transfer the toner image formed on the photoconductor drum 20 onto the intermediate transfer belt 10. Then, the secondary transfer roller 5 applies a transfer bias to the sheet S entering the secondary transfer nip at a predetermined timing to transfer the toner image formed on the intermediate transfer belt 10 onto the sheet S.

The sheet S bearing the toner image is conveyed toward the fixing device 80, and the fixing device 80 fixes the toner image onto the sheet S. After the fixing of the toner image to the sheet S, an ejection roller pair 7 ejects the sheet S, and the sheet S is stacked on an output tray. As the photoconductor drum 20 rotates, the residual toner remaining on the surface of photoconductor drum 20 and the intermediate transfer belt 10 without being transferred from the photoconductor drum 20 and the intermediate transfer belt 10 to the sheet S reaches the cleaning device 50 (i.e., the cleaning device 50Y, 50C, 50M, or 50K) or a cleaning device 70. Then the cleaning blade scrapes the residual toner to clean the surface of the photoconductor drum 20 while the residual toner passes through the cleaning device 50 or the cleaning device 70. After the cleaning device 50 and the cleaning device 70 clean the photoconductor drum 20, a discharger discharges a residual potential on the photoconductor drum 20, and the photoconductor drum 20 is prepared for the next image forming operations.

Figure 2:
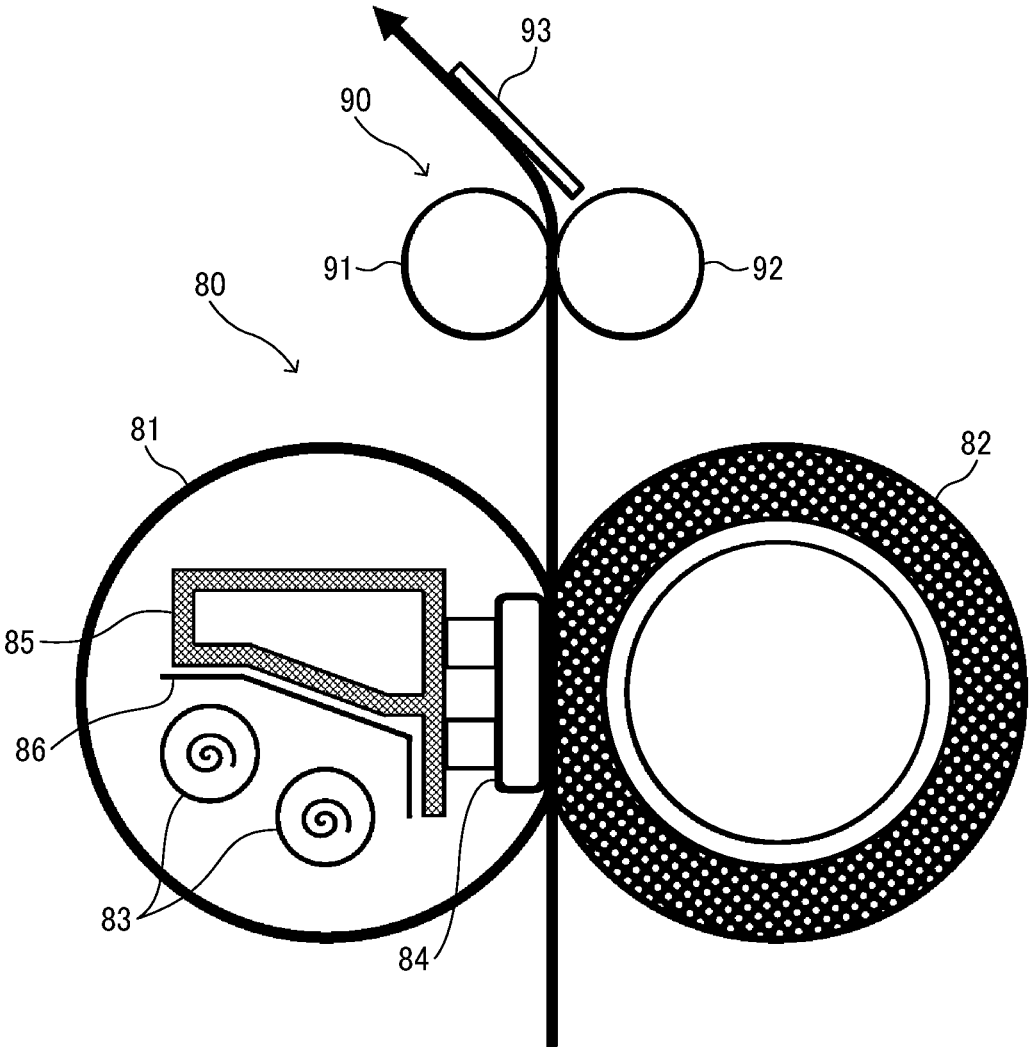
FIG. 2 is a diagram illustrating a schematic configuration of a fixing device included in the image forming apparatus of FIG. 1.

FIG. 2 is a diagram illustrating a schematic configuration of the fixing device 80. The fixing device 80 includes a fixing sleeve 81 and a pressure roller 82. The fixing sleeve 81 is directly heated by radiation heat of heat sources 83 from the inner peripheral side of the fixing sleeve 81. FIG. 2 illustrates halogen heaters as an example of the heat sources 83. A nip formation pad 84 is disposed inside the fixing sleeve 81 illustrated in FIG. 2 and faces the pressure roller 82 via the fixing sleeve 81 to form a nip region (also referred to as a fixing nip region) between the pressure roller 82 and the fixing sleeve 81. The nip formation pad 84 slides directly or indirectly via a slide sheet over the inner surface of the fixing sleeve 81.

In FIG. 2, the nip region has a flat shape. However, in some embodiments, the nip region may have a concave shape or any other suitable shape. The concave shape of the nip region is advantageous in that the ejecting direction of a leading edge of a recording sheet is close to the pressure roller to enhance the sheet separation and reduce occurrence of a jam.

The fixing sleeve 81 is a metal sleeve made of, for example, nickel or steel use stainless (SUS), or an endless sleeve (or film) using a resin material such as polyimide. The surface layer of the fixing sleeve 81 includes a release layer such as a perfluoroalkoxy alkane (PFA) or polytetrafluoroethylene (PTFE) layer to facilitate separation of toner of a toner image on a recording medium so that toner does not adhere to the surface of the fixing sleeve 81. An elastic layer may be sandwiched between the base material of the fixing sleeve 81 and the PFA or PTFE layer, and the elastic layer may be made of silicone rubber. Omitting the elastic layer made of silicone rubber reduces heat capacity and improve energy saving. However, the slight surface roughness of the fixing sleeve 81 may be transferred onto a recording medium while a toner image is fixed onto the recording medium, causing an orange-peel image, which is an image having uneven gloss in a solid part of the image. To address this circumstance, the elastic layer made of silicone rubber has a thickness not smaller than 100 μm. Deformation of the elastic layer made of silicone rubber absorbs the slight surface asperities in the fixing sleeve 81, preventing formation of a faulty image having uneven gloss (e.g., an orange peel image).

The fixing device 80 includes a support member 85 (serving as a stay) inside the fixing sleeve 81 to support the nip region. The support member 85 prevents bending of the nip formation pad 84 that receives pressure by the pressure roller 82, thus obtaining a uniform nip width in the axial direction of the support member 85. By supporting the pressure from the pressure roller 82 at the support member 85, the nip formation pad 84 obtains the surface pressure in the fixing nip region to fuse and fix toner on the toner image to the recording medium.

The support member 85 is formed by bending iron or stainless steel and has a large heat capacity with an iron plate or a SUS plate having a thickness of approximately 2 mm to 4 mm. The support member 85 is held and secured by a holder and positioned at both ends of the support member 85. The fixing device 80 includes a reflector 86 between the heat source 83 and the support member 85. The reflector 86 reflects the radiation heat from the heat sources 83 toward the inner circumferential surface of the fixing sleeve 81. Accordingly, the support member 85 can be prevented from being unnecessarily heated by the heat sources 83, thus reducing waste of energy. Here, the same effect can be obtained even if the surface of the support member 85 is heat-insulated or mirror-finished instead of including the reflector 86.

The pressure roller 82 includes an elastic rubber layer on a core metal. A release layer (PFA or PTFE layer) is disposed on the outer surface of the pressure roller 82 in order to obtain releasability. As described below, a driving force is transmitted to the pressure roller 82 through gears from a driving source, such as a motor, provided in the printer 100, to rotate the pressure roller 82. A spring presses the pressure roller 82 against the nip formation pad 84 via the fixing sleeve 81. As the spring presses and deforms the elastic rubber layer of the pressure roller 82, the pressure roller 82 produces the fixing nip region having the predetermined length in the sheet conveyance direction. The pressure roller 82 may be a hollow roller. Alternatively, the pressure roller 82 may include a heating source such as a halogen heater. The elastic rubber layer may be made of solid rubber. Alternatively, if no heater is situated inside the pressure roller 82, the elastic rubber layer may be made of sponge rubber. The sponge rubber is preferable because the sponge rubber has an increased insulation that draws less heat from the fixing sleeve 81.

The fixing sleeve 81 rotates in accordance with rotation of the pressure roller 82. Specifically, as a driving source drives and rotates the pressure roller 82, a driving force of the driving source is transmitted from the pressure roller 82 to the fixing sleeve 81 by a frictional force of the nip region, thus rotating the fixing sleeve 81. The fixing sleeve 81 is sandwiched and rotated at the nip region, and travels while being guided by holders (flanges) at both ends in other portions than the nip region. With the construction described above, the fixing device 80 attaining quick warm-up is manufactured at reduced costs.

Curl of Sheet S

The sheet S that has been left in a high temperature and high humidity environment for a long time absorbs moisture to increase the water content. In particular, recycled paper has a high hygroscopic property and tends to have a high water content. When such a sheet like the sheet S passes through the fixing device 80 when the temperature difference between the fixing sleeve 81 and the pressure roller 82 is high, a temperature difference occurs between the front and back surfaces of the sheet, moisture moves from the high temperature side (fixing sleeve side) to the low temperature side (pressure roller side), the sheet shrinks due to moisture evaporation from the pressure roller side, and then the sheet curls to the opposite side of the printing surface (back curl).

In order to correct the back curl of the sheet S, prior to generation of a back-edge curl, the bending force in the opposite direction is applied to the sheet S. A decurling device 90 is disposed downstream from the fixing device 80 in the sheet conveyance direction and is rotated by the driving force transmitted from the same driving source as the pressure roller 82. A cooling pressure roller 91 is driven to rotate by the frictional force from a cooling pressure roller 92. The sheet passes through a nip region sandwiched between the cooling pressure roller 91 and the cooling pressure roller 92 and is bent by a guide plate 93 to correct the curl. In the present embodiment, the decurling device 90 employs cooling pressure rollers.

In other words, the decurling device 90 includes the cooling pressure roller 91 and the cooling pressure roller 92. Typically, rollers such as a conveyance roller or a decurler as a curl correcting device may be used after fixing the toner image. However, in the present embodiment, the decurling device 90 employs the cooling pressure rollers instead of these rollers. The cooling pressure rollers are rollers having an elastic layer uniformly in the axial direction. The waving of the sheet is reduced by pulling the sheet at a slightly increased linear velocity of the cooling pressure roller 92 compared with the pressure roller 82.

One of the pair of rollers may be a hard roller in the curl correcting device. In the present embodiment, both rollers of the curl correcting device 90 are elastic rollers each including an elastic layer. The distance between the axes of the cooling pressure rollers is fixed. The surface pressure of the cooling pressure rollers is relatively small when plain paper is printed in an image forming mode. The surface pressure of the cooling pressure rollers is relatively large and the nip width is widened when a recording medium sandwiched and thickened by lamination films on the front and back sides passes the cooling pressure rollers in a lamination mode. The image forming mode and the lamination mode are described below. When a thick film passes through the cooling pressure rollers, a relatively large pressure is applied to the thick film so that the laminated film is sufficiently pressed. In addition, since the elastic layer of the cooling pressure roller is compressed in the radial direction and stretched in the circumferential direction at the nip region as compared with the case of printing on plain paper, the linear velocity at the nip region is increased as compared with the case of printing on plain paper.

Laminating Process

The sheet feeding device 60 includes a sheet feed tray as a sheet container for a recording medium. When printing on a sheet, a large number of cut sheets of recording media are loaded in the sheet feed tray of the sheet feeding device 60. On the other hand, when the laminating process is executed, printed sheets each sandwiched between pouch-type lamination films by a user are loaded in the sheet feed tray of the sheet feeding device 60.

The pouch-type lamination film is a sheet in which one side of four sides of two films is bonded or one film is folded into two to sandwich a printed material. The sheet is loaded in the sheet feed tray so that the bonded side of the sheet or the folded side of the sheet faces downstream in the sheet feeding direction.

The image forming apparatus includes a bypass tray 61 separately from the sheet feed tray as illustrated in FIG. 1. On the other hand, when the laminating process is executed, the lamination film may be loaded in the bypass tray 61.

Drive Transmission Mechanism for Sheet Conveyance

In the present embodiment, the printer 100 has the image forming mode and the lamination mode. The conveying speed of a sheet in the fixing device in the lamination mode is slower than the conveying speed of the sheet in the image forming mode. In a case where the drive motor is driven at a rotational speed lower than a rated range as a method of low linear velocity conveyance in the lamination mode, a rotational speed variation may occur. Therefore, a speed reducer is usually used in order to drive the drive motor at a low linear velocity. On the other hand, when the speed reducer is used, a costly motor that rotates at high-speed rotation is used in order to drive at a rotation speed for normal printing. As a result, the cost is increased. In particular, since the linear velocity of a conveyance motor for conveying other than a motor for fixing and transferring toner is faster than the process linear velocity of the motor for fixing and transferring toner in order to reduce the printing time, a costly motor is used in a case where the speed reducer is used to reduce the linear velocity in the lamination mode. On the other hand, since the maximum speeds (the maximum speed in the image forming mode) of the fixing roller and the transfer roller are not so high, driving the fixing roller and the transfer roller is achieved from a low speed to a normal speed by using the speed reducer without using a costly motor.

Figure 3:
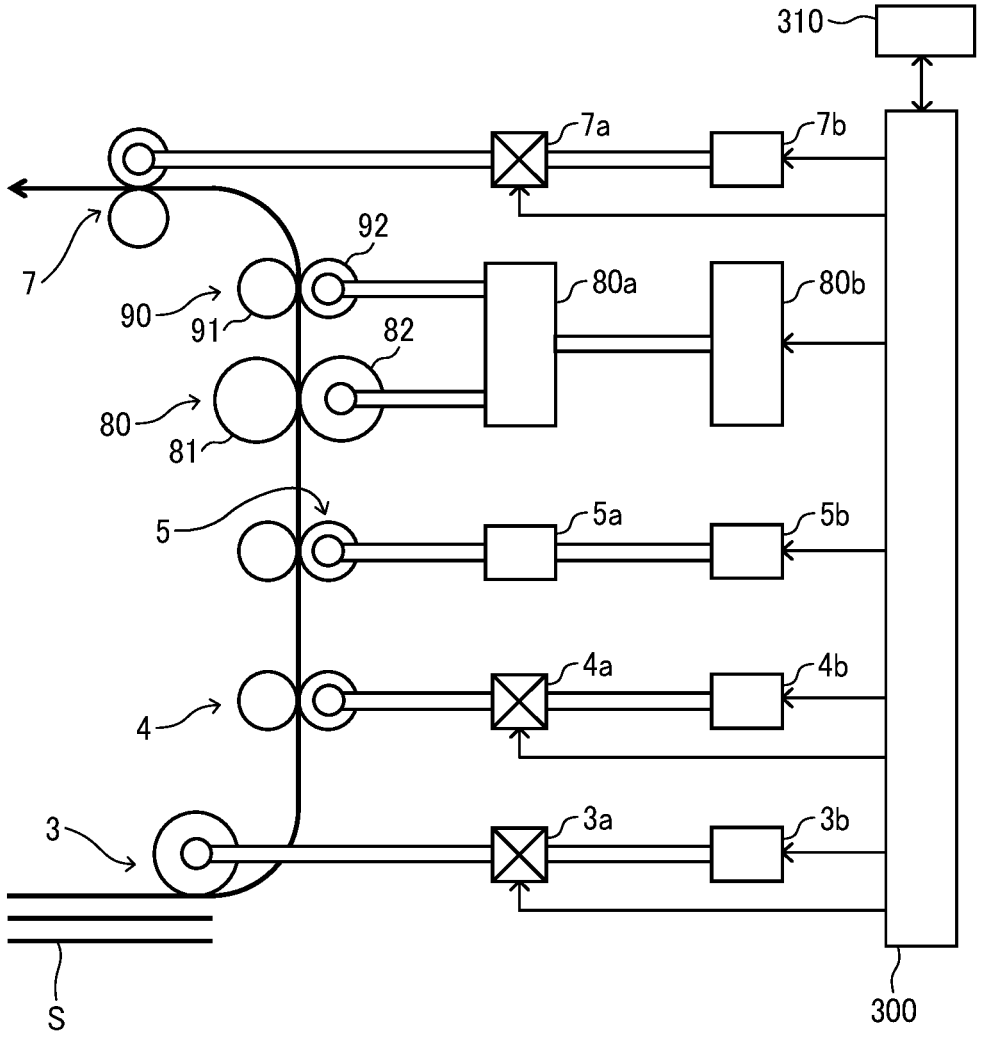
FIG. 3 is a diagram illustrating a schematic configuration of a drive transmission mechanism related to sheet conveyance in the image forming apparatus of FIG. 1.

FIG. 3 is a diagram illustrating a schematic configuration of a drive transmission mechanism related to sheet conveyance in the image forming apparatus according to the present embodiment.

The sheet feed roller 3 is driven by a drive motor 3*b* via a clutch 3*a* serving as a drive transmission connection changer. When the conveying force is applied to the sheet S, the clutch 3*a* is engaged, so that the drive motor 3*b* rotates to convey the sheet S. When the clutch 3*a* is disengaged (disconnected) from the drive motor 3*b*, the conveying force is not applied to the sheet S, and the sheet S is conveyed by the conveying force of another driving source. The registration roller pair 4 and the ejection roller pair 7 have substantially the same configuration as the configuration of the sheet feed roller 3, the clutch 3*a*, and the drive motor 3*b*.

The secondary transfer roller 5 is driven by a drive motor 5*b* via a speed reducer 5*a*. The fixing device 80 is driven by a drive motor 80*b* via a speed reducer 80*a*. A low linear velocity in the lamination mode is achieved by the speed reducer. The following motors are used as these drive motors. When a normal motor is rotated at a speed lower than a predetermined range, problems of unevenness of rotation or stop accuracy occur. In the present embodiment, a motor with a reduction ratio of 50 times is used to avoid problems of unevenness of rotation and stopping accuracy even at a linear velocity of 10 mm/sec in the lamination mode. The motor applies torque that is sufficient to rotate at 150 mm/sec in the normal printing. The linear velocity is changed by changing the rotation speed of the drive motor 80*b*. The clutches and the drive motors are controlled by a controller 300. An operation panel 310 for operation such as a selecting the lamination mode is connected to the controller 300.

In this embodiment, the lamination film is conveyed at a normal linear velocity until the lamination film reaches the secondary transfer roller 5 in the lamination mode. The driving forces of the conveyance rollers are disengaged by the clutches while the lamination film is sandwiched by the secondary transfer roller 5, the pressure roller 82, and the cooling pressure roller 92, so that the lamination film is conveyed by driving force of each of the secondary transfer roller 5, the pressure roller 82, and the cooling pressure roller 92. After passing through the cooling pressure roller 92, the driving forces of the conveyance rollers are engaged again by the clutches, and the lamination film is conveyed at the normal linear velocity. In the case where the secondary transfer roller 5 is brought into contact with and separated from the sheet, the secondary transfer roller 5 may be separated from the sheet during the laminating process.

Specific examples are described below. The sheet feed roller 3 and the registration roller pair 4 rotate at a low printing linear velocity of 75 mm/sec to convey a lamination film, i.e., a recording medium sandwiched between lamination films on both sides. When the leading edge of the lamination film reaches the secondary transfer roller 5, the clutch 3*a* and a clutch 4*a* are disengaged from the drive motor 3*b* and a drive motor 4*b*, respectively. As a result, the conveying force is not transmitted to the lamination film. The secondary transfer roller 5, the fixing device 80, and the cooling pressure rollers 91 and 92 rotate at a linear velocity of 30 mm/sec or 20 mm/sec to attach the lamination film while conveying the lamination film. When the trailing edge of the lamination film passes through the cooling pressure rollers 91 and 92, a clutch 7*a* is engaged with a drive motor 7*b*, then the ejection roller pair 7 rotates at a low printing linear velocity 75 mm/sec to eject the lamination film.

Each of the sheet feed roller 3, the registration roller pair 4, and the ejection roller pair 7 rotates at a faster linear velocity than the linear velocities of the secondary transfer roller 5 and the fixing device 80, serving as image forming units, in order to reduce the time from sheet feeding to sheet ejecting. When the laminating process is executed, the printing linear velocity is 50% or less of the low printing linear velocity. It is more preferable that the printing linear velocity is 30% or less of the low printing linear velocity. The difference is constantly 10 times or more between the conveyance linear velocity other than fixing and transfer during normal printing and the lamination linear velocity. The drive motor is rated to rotate at a linear velocity of about eight times as fast as a regular drive motor. The torque is insufficient when the linear velocity is higher than the linear velocity of the drive motor, and the rotation speed of the motor is not stable when the linear velocity is lower than the linear velocity of the drive motor.

Therefore, the linear velocity of the fixing device 80 having effects on the lamination quality may be reduced. Alternatively, since the linear velocity of the secondary transfer roller 5 is not increased, the linear velocity of the secondary transfer roller 5 is synchronized with the linear velocity of the fixing device 80 at a low linear velocity, then the linear velocity of the secondary transfer roller 5 may be reduced. As a result, the lamination quality is improved by reducing the linear velocities of the fixing device 80 and the secondary transfer roller 5.

Verification Test

Figure 4:
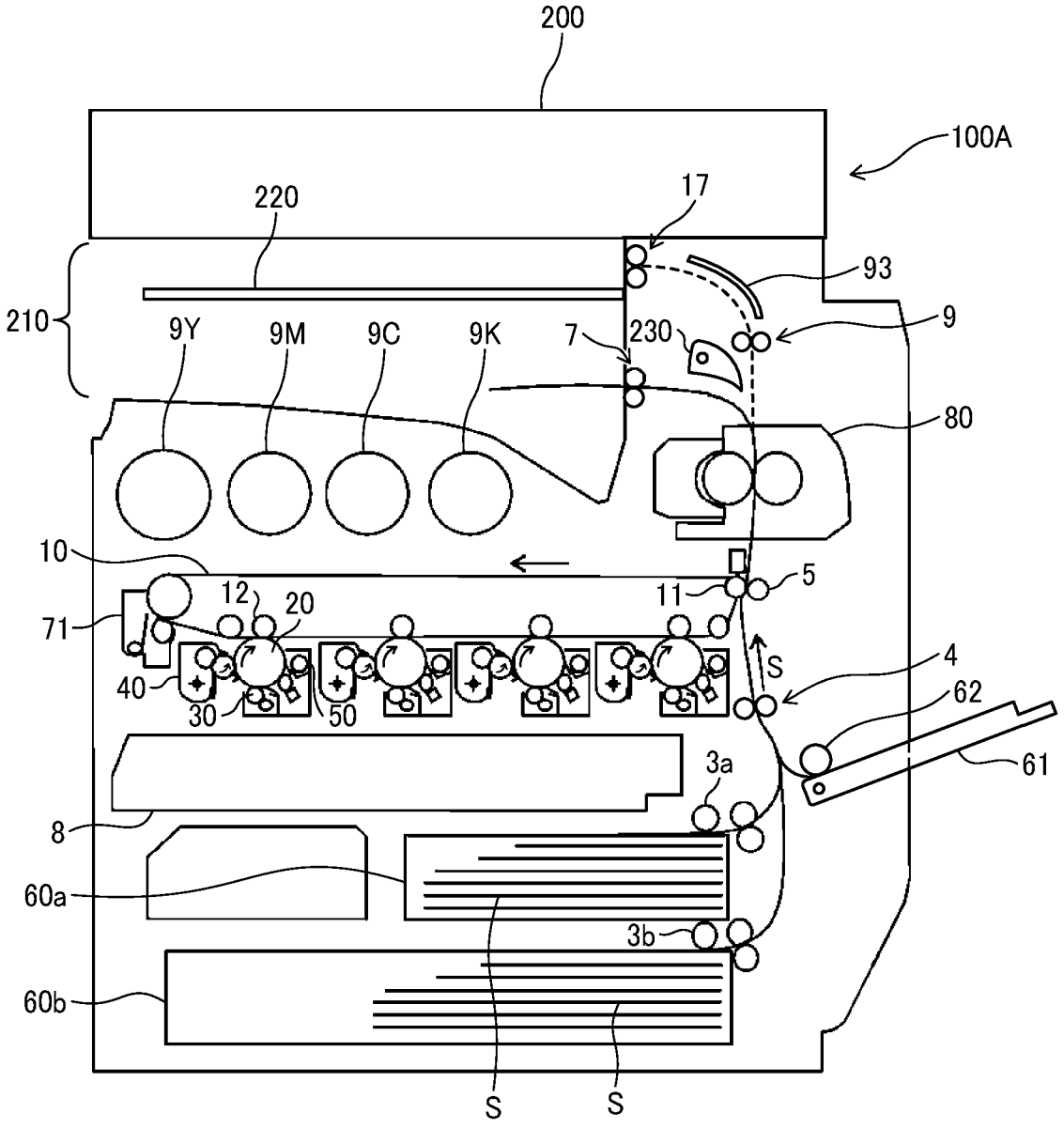
FIG. 4 is a schematic view of an image forming apparatus of an internal sheet ejection type, according to an embodiment of the present disclosure.

The lamination quality evaluation was performed using a modified multi-function product (MFP) MP C5504 (product name) manufactured by Ricoh Company, Ltd. This MFP employs an in-body sheet ejection method and having upper and lower sheet ejection openings in the body. The MFP includes an internal middle tray 220 (internal output tray) for receiving sheets ejected from the upper sheet ejection opening. FIG. 4 illustrates an example of an apparatus that includes the same type of internal sheet ejection method.

Different from the printer 100 illustrated in FIG. 1, a printer 100A illustrated in FIG. 4 includes a scanner 200 disposed in the upper portion of the printer 100A. A space 210 for ejecting sheets is provided between the bottom of the scanner 200 and the top of the printer 100A. An internal middle tray 220 is horizontally disposed so as to partition the space 210 into upper and lower parts. A sheet ejection opening through which a sheet is ejected from the ejection roller pair 7 is disposed below the internal middle tray 220, and another sheet ejection opening through which a sheet is ejected from the ejection roller pair 17 is disposed above the internal middle tray 220. In addition, a switching claw 230 is provided for switching directions of the sheet conveyed from the fixing device 80 to a selected sheet ejection roller pair. The decurling device 90 including the cooling pressure rollers 91 and 92 and the guide plate 93 are disposed between the fixing device 80 and the ejection roller pair 17 along the conveyance direction of the sheet S.

In the FIG. 4, a sheet feeding tray 60*a* and a sheet feeding tray 60*b* are disposed in upper and lower stages. In addition, FIG. 4 illustrates the bypass tray 61 and a sheet feeding roller 62. The bypass tray 61 is in the open position in FIG. 4. The sheet feeding roller 62 feeds a sheet loaded in the bypass tray 61. The configuration of the printer 100A in FIG. 4 is a tandem structure of four colors of yellow, magenta, cyan and black and is basically the same as the configuration of the printer 100 in FIG. 1 except for the above-described features. Therefore, the corresponding members are denoted by the same reference numbers.

The lamination film used in the verification test was a lamination film of 100 μm manufactured by Iris Ohyama Inc. The inner sheet used in the verification test was My Paper (product name) sheet manufactured by Ricoh Company, Ltd. A solid image was printed on the whole surface of the inner sheet. The verification test was conducted to evaluate the following three items.

Adhesion Evaluation

Very Good: Lamination film is adhered with sufficient strength and no melting unevenness of the glue is observed;

Good: Lamination film is adhered with sufficient strength but melting unevenness of the glue is observed;

Acceptable: Lamination film is adhered, but strength is insufficient; and

Poor: Lamination film is adhered partially and is peeling easily.

Waving Evaluation

Very Good: No waving;

Good: Partially small waving;

Acceptable: Small waving over the film; and

Poor: Large waving over the film.

Curling Amount Evaluation

Very Good: Curling amount is less than 5 mm;

Good: Curling amount is 5 mm or more and less than 10 mm;

Acceptable: Curling Amount is 10 mm or more and less than 20 mm; and

Poor: Curling Amount is 20 mm or more.

The curl amount is measured by placing a curled sheet on a horizontal plane and measuring the height of the highest portion of the curled sheet.

The evaluation conditions of Embodiments 1 to 4 and Control Samples 1 to 3 are as described in Table 1 including Table 1-1 and Table 1-2. Note that "CON" represents "Control Sample" and "EMB" represents "Embodiment."

TABLE 1-1

| | Conditions | | | | |
|---|---|---|---|---|---|
| | Normal Printing Velocity (mm/sec) | Low Printing Velocity (mm/sec) | Lamination Linear Velocity (mm/sec) | Cooling Pressure Rollers | Distance between Axes of Cooling Pressure Roller |
| EMB 1 | 150 | 75 | 30 | YES | Fixed |
| EMB 2 | 150 | 75 | 20 | YES | Fixed |
| EMB 3 | 150 | 75 | 20 | YES | Not Fixed |
| EMB 4 | 150 | 75 | 20 | YES | Fixed |
| CON 1 | 150 | 75 | 75 | YES | Fixed |
| CON 2 | 150 | 75 | 40 | YES | Fixed |
| CON 3 | 150 | 75 | 30 | NO | N/A |

TABLE 1-2

| | Conditions | | Quality | | |
|---|---|---|---|---|---|
| | Nip widths of Cooling Pressure Roller in Lamination Mode (mm) | Output Tray | Adhesion | Waving | Curling Amount |
| EMB 1 | 2 | Internal Output Tray | Good | Good | Good |
| EMB 2 | 2 | Internal Output Tray | Very Good | Very Good | Very Good |
| EMB 3 | 0.5 | Internal Output Tray | Very Good | Acceptable | Very Good |
| EMB 4 | 2 | Regular Tray | Very Good | Very Good | Acceptable |
| CON 1 | 2 | Internal Output Tray | Poor | Poor | Poor |
| CON 2 | 2 | Internal Output Tray | Acceptable | Acceptable | Acceptable |
| CON 3 | N/A | Internal Output Tray | Good | Poor | Good |

Embodiment (EMB) 1

The laminating process was performed under the conditions described in Table 1 for Embodiment 1. The adhesion of the lamination film was enhanced by setting the lamination linear velocity to 30 mm/sec that is 50% or less of the low printing linear velocity of 75 mm/sec. By applying pressure by the cooling pressure roller and applying tensile force, waving of the lamination film due to heat shrinkage after the lamination film has passed through the fixing device 80 was reduced, and deformation was prevented by cooling the lamination film. In addition, by ejecting the sheet to the internal middle tray 220 (internal output tray) instead of ejecting the sheet to a regular in-body tray (an output tray below the internal middle tray 220), the minimum curvature radius of a conveyance passage through which the lamination film is ejected is reduced from 50 mm to 100 mm, and curling is prevented.

Embodiment 2

The laminating process was performed under the conditions described in Table 1 for Embodiment 2. The adhesion of the lamination film was enhanced by setting the lamination linear velocity to 20 mm/sec that is 30% or less of the low printing linear velocity. In addition, due to the further lowering of the linear velocity, the cooling time was prolonged, and the waving and curling qualities were enhanced.

Embodiment 3

The laminating process was performed under the conditions described in Table 1 for Embodiment 3. Since the distance between the axes of the cooling pressure rollers were varied under the condition of Embodiment 3, the nip widths during the laminating process were 0.5 mm, then it was evaluated that the waving quality was deteriorated.

Embodiment 4

The laminating process was performed under the conditions described in Table 1 for Embodiment 4. Since the ejection destination was the internal tray, the curling quality was deteriorated.

Control Sample (CON) 1

The laminating process was performed under the conditions described in Table 1 for Control Sample 1. Since both the lamination linear velocity and the low printing linear velocity were 75 mm/sec, the adhesion, the waving quality, and the curling quality were evaluated as poor.

Control Sample 2

The laminating process was performed under the conditions described in Table 1 for Control Sample 2. Since the lamination linear velocity was 40 mm/sec and is more than 50% of the low printing linear velocity of 75 mm/sec, the waving quality, and the curling quality were evaluated as acceptable.

Control Sample 3

The laminating process was performed under the conditions described in Table 1 for Control Sample 3. Since the cooling pressure rollers 91 and 92 were not provided, the waving quality was evaluated as poor.

As described above, the image forming apparatus according to the present embodiment includes a fixing device that fixes a toner image formed on a recording medium. The fixing device includes a fixing rotator and a pressing rotator, and a cooling pressure roller. The pressing rotator is in contact with the fixing rotator and forms a nip region with the fixing rotator. The cooling pressure roller is disposed downstream from the pressing rotator in the conveyance direction of the recording medium. The cooling pressure roller conveys the lamination film at a linear velocity that is 50% or less than the lowest printing velocity of the several normal printing modes. The cooling pressure roller applies pressure to the overall axial surface. Therefore, by performing lamination at a relatively low speed that is different from normal printing, the glue of the lamination film may be heated and melted sufficiently. The adhesion of the lamination film may be enhanced by conveying the sheet at the linear velocity that is 50% or less than the normal printing velocity during the laminating process. Since a linear velocity of normal printing is typically high, when a laminating process is executed at the linear velocity, heat is not sufficiently transmitted to the lamination film, failing to fix the lamination film.

Further, the cooling pressure roller may reduce waving after the sheet has passed through the fixing device. Since a cooling pressure roller is not typically provided after the fixing process, waving is likely to occur due to contraction after the heating process from the fixing device. When a cooling time is relatively short, the waving is also likely to occur. When the cooling time is short, the film is likely to be scratched or curled.

On the other hand, when the cooling pressure roller is provided, the cooling pressure roller contracts in a pressed state, that is, in a constrained state. Due to this configuration, the waving is not likely to occurs. In other words, since the contraction of the lamination film after the heating in an unconstrained state is in a free state, the waving of the lamination film is likely to occur. The cooling time after the heating may be allocated sufficiently.

As described above, the image forming apparatus according to the present embodiment achieves the following modes effectively.

Mode 1

An image forming apparatus includes a fixing device configured to fix an image on a sheet by application of heat and pressure, and a drive transmission mechanism. The drive transmission mechanism is configured to change between a sheet conveying speed in the fixing device in an image forming mode and a sheet conveying speed in the fixing device in a lamination mode. The sheet conveying speed in the fixing device in the lamination mode is slower than the sheet conveying speed in the fixing device in the image forming mode. In the image forming apparatus that switches a plurality of sheet conveying speeds according to a sheet type such as the thickness of a sheet in the image forming mode, the sheet conveying speed in the fixing device in the lamination mode is slower than the slowest sheet conveying speed in the image forming mode. By reducing the fixing speed in the lamination mode as described above, the lamination film may be pressed and heated more satisfactory when compared to the case in which the sheet conveying speed is used in the fixing device in the image forming mode. As a result, the adhesion of the lamination film is enhanced, and the laminating process is also enhanced. When the sheet conveying speed for fixing the lamination film is substantially the same as the sheet conveying speed in the image forming mode, the conveying speed is too fast and heat is not sufficiently transmitted to the lamination film. As a result, sufficient adhesive strength is not obtained.

Mode 2

The image forming apparatus according to Mode 1, the sheet conveying speed in the fixing device in the lamination mode is 50% of or less than the sheet conveying speed in the fixing device in the image forming mode.

Mode 3

The image forming apparatus according to Mode 2, the sheet conveying speed in the fixing device in the lamination mode is 30% of or less than the sheet conveying speed in the fixing device in the image forming mode. As the speed lowers, the adhesion of the lamination film is more enhanced.

Mode 4

The image forming apparatus according to any one of Modes 1 to 3, the drive transmission mechanism includes a sheet conveying member configured to convey the sheet, the speed of sheet conveying in the fixing device in the lamination mode is slower than the sheet conveying speed of the sheet conveying member in a period until a leading edge of the sheet reaches the fixing device and at least a part of a period after a trailing edge of the sheet passes through the fixing device in the lamination mode. That is, when the lamination film is conveyed in the image forming apparatus, the linear velocity of the fixing device (or the fixing device and the transfer device while the transfer device sandwiches a sheet) is slower than the linear velocity of conveying members other than the above-described devices such as conveyance rollers.

Mode 5

The image forming apparatus according to Mode 4, the speed of sheet conveying in the fixing device in the lamination mode is 50% of or less than the speed of sheet conveying in the fixing device in the image forming mode.

According to Modes 4 and 5, the sheet conveying speed in the period until the leading edge of the sheet reaches the fixing device and at least a part of the period after the trailing edge of the sheet passes through the fixing device is faster than the sheet conveying speed of the fixing device in the lamination mode, and the processing speed may be increased accordingly.

Mode 6

The image forming apparatus according to any one of Modes 1 to 5, the drive transmission mechanism includes an upstream sheet conveying member upstream from the fixing device in the conveyance direction of the sheet, a downstream sheet conveying member downstream from the fixing device in the conveyance direction of the sheet, a drive source configured to drive each of the upstream sheet conveying member and the downstream sheet conveying member, and a drive transmission connection changer. The drive transmission connection changer is configured to change connection of at least one of the upstream sheet conveying member and the downstream sheet conveying member with the drive source when a drive force is transmitted from the drive source to each of the upstream sheet conveying member and the downstream sheet conveying member.

Mode 7

The image forming apparatus according to Mode 6, the drive transmission connection changer is configured to block transmission of the drive force of each of the upstream sheet conveying member and the downstream sheet conveying member facing the fixing device during a period in which the sheet being conveyed by the fixing device faces the at least one of the upstream sheet conveying member and the downstream sheet conveying member.

According to Modes 6 and 7, the sheet conveying member is disposed at a position facing the sheet conveyed in the fixing device. While the sheet conveyed in the fixing device faces the sheet conveying member, the drive transmission connection changer blocks drive transmission, and the sheet may be conveyed by the fixing device. For example, while the lamination film is sandwiched by the transfer roller, the fixing roller, and the cooling pressure roller, the lamination film is conveyed by the driving forces of the transfer roller, the fixing roller, and the cooling pressure roller. By so doing, the lamination film may be conveyed without any problem. As a result, a less costly motor may be used as the motor of the sheet conveying member provided with the drive transmission connection changer.

Mode 8

The image forming apparatus according to any one of Modes 1 to 8, further includes cooling pressure rollers disposed downstream from the fixing device in the sheet conveyance direction.

Mode 9

The image forming apparatus according to Mode 8, the cooling pressure rollers are a pair of rollers provided with an elastic layer, and a distance between axes of the cooling pressure rollers in the image forming mode is equal to a distance between axes of the cooling pressure rollers in the lamination mode.

Mode 10

The image forming apparatus according to Mode 8 or 9, the cooling pressure rollers are a pair of rollers, at least one of the cooling pressure rollers includes an elastic layer, a nip width of each of the cooling pressure rollers is less than or equal to 1 mm when a plain paper is nipped between the cooling pressure rollers, and the nip width of each of the cooling pressure rollers is in a range of more than or equal to 1 mm and less than or equal to 3 mm when the sheet is nipped by a lamination film.

Mode 11

The image forming apparatus according to any one of Modes 8 to 10, a surface layer of the cooling pressure rollers is a release layer.

According to Modes 8 to 11, the occurrence of waving, scratches on the lamination film, and curling of the lamination film may be reduced. This effect is achieved due to the following reasons. The distance between the axes of the cooling pressure rollers is constant regardless of the printing mode and the type of recording medium, and the pressure to the recording medium changes in accordance with the thickness of the recording medium. When printing is performed on a plain paper at a normal linear velocity, the surface pressure of the plain paper is relatively low, and the torque of the drive motor does not increase. On the other hand, since a large surface pressure is applied during the laminating process, waving of the lamination film may be reduced. In addition, the linear velocity of each cooling pressure rollers is pulled at a speed slightly faster than the speed of the fixing roller to further reduce waving of the lamination film. When a thick film passes between the cooling pressure rollers, the elastic layer is deformed to increase the linear velocity. In particular, according to Mode 11, toner adhesion on the image surface may be reduced.

Mode 12

The image forming apparatus according to any one of Modes 1 to 11, further includes at least two sheet ejection openings through which the sheet from the fixing device is ejected. Of the at least two sheet ejection openings, the sheet is ejected through a sheet ejection opening having a longer conveyance path from the fixing device in the lamination mode. Due to such a configuration, curling of the lamination film may be reduced.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

What is claimed is:

1. An image forming apparatus comprising:

a fixing device configured to fix an image on a sheet by application of heat and pressure;

a drive transmission mechanism configured to change a conveying speed of the sheet in the fixing device between an image forming mode and a lamination mode, wherein the drive transmission mechanism comprises:

a plurality of drive sources each configured to apply a drive force to move the sheet in a linear direction at a linear velocity;

one or more speed reducers, each coupled with a corresponding drive source of the plurality of drive sources, each of the one or more speed reducers configured to selectively adjust the linear velocity of the sheet; and one or more clutches coupled with one or more drive sources of the plurality of drive sources, each of the one or more clutches configured to selectively engage and disengage drive force from one or more drive sources of the plurality of drive sources; and a controller coupled with the plurality of drive sources and coupled with the one or more clutches, the controller configured to convey the sheet in portions of the image forming device at a first speed, the controller further configured to convey the sheet in the fixing device in the lamination mode at a second speed slower than the first speed.

2. The image forming apparatus according to claim 1, wherein the second speed conveying the sheet in the fixing device in the lamination mode is 50 percent or less of the first speed conveying the sheet.

3. The image forming apparatus according to claim 2, wherein the second speed conveying the sheet in the fixing device in the lamination mode is 30 percent or less of the first speed of the sheet.

4. The image forming apparatus according to claim 1, wherein the drive transmission mechanism includes a sheet conveyor configured to convey the sheet, wherein the second speed conveying the sheet in the fixing device in the lamination mode is lower than the first speed conveying the sheet of the sheet conveyor in a period until a leading edge of the sheet reaches the fixing device and at least a part of a period after a trailing edge of the sheet passes through the fixing device in the lamination mode.

5. The image forming apparatus according to claim 4, wherein the second speed conveying the sheet in the fixing device in the lamination mode is 50 percent or less of the first speed.

6. The image forming apparatus according to claim 1, wherein the drive transmission mechanism further comprises:

an upstream sheet conveyor upstream from the fixing device in a conveyance direction of the sheet, wherein one or more drive sources of the plurality of drive sources drive the upstream sheet conveyor;

a downstream sheet conveyor downstream from the fixing device in the conveyance direction of the sheet, wherein one or more drive sources of the plurality of drive sources drive the downstream sheet conveyor; and a drive transmission connection changer disposed between the drive source and at least one of the upstream sheet conveyor or the downstream sheet conveyor and configured to connect at least one of the upstream sheet conveyor or the downstream sheet conveyor with the drive source to transmit a drive force from the drive source to the at least one of the upstream sheet conveyor or the downstream sheet conveyor.

7. The image forming apparatus according to claim 6, wherein the drive transmission connection changer is configured to block transmission of the drive force to the at least one of the upstream sheet conveyor or the downstream sheet conveyor during a period in which the sheet being conveyed in the fixing device faces the at least one of the upstream sheet conveyor or the downstream sheet conveyor.

8. The image forming apparatus according to claim 1, further comprising a plurality of cooling pressure rollers disposed downstream from the fixing device in a sheet conveyance direction.

9. The image forming apparatus according to claim 8, wherein the plurality of cooling pressure rollers are a pair of rollers each including an elastic layer, and wherein a distance between axes of the pair of rollers in the image forming mode is equal to a distance between axes of the pair of rollers in the lamination mode.

10. The image forming apparatus according to claim 8, wherein the plurality of cooling pressure rollers are a pair of rollers, wherein at least one of the pair of rollers includes an elastic layer, wherein a nip width of each one of the pair of rollers is less than or equal to 1 millimeter when the pair of rollers nips the sheet being of plain paper, and wherein the nip width of each one of the pair of rollers is in a range of more than or equal to 1 millimeter and less than or equal to 3 millimeters when the pair of rollers nips the sheet having a lamination film on front and back sides of the sheet.

11. The image forming apparatus according to claim 8, wherein a surface layer of the cooling pressure rollers is a release layer.

12. The image forming apparatus according to claim 1, further comprising at least two sheet ejection ports through which the sheet from the fixing device is ejected, and wherein, of the at least two sheet ejection ports, the drive transmission mechanism ejects the sheet through a sheet ejection port having a longer conveyance path from the fixing device in the lamination mode.

* * * * *